US005809899A

United States Patent [19]

Kaufhold et al.

[11] Patent Number: 5,809,899

[45] Date of Patent: Sep. 22, 1998

[54] DRAFT SILL AND WHEEL TRUCK CONNECTION

[75] Inventors: Horst T. Kaufhold; John J. Steffen, both of Aurora, Ill.; Franklin S. McKeown, Jr., St. Louis, Mich.

[73] Assignee: AMSTED Industries Incorporated, Chicago, Ill.

[21] Appl. No.: 671,701

[22] Filed: Jun. 28, 1996

[51] Int. Cl.[6] ..... B61F 5/16

[52] U.S. Cl. ..... 105/199.4

[58] Field of Search ..... 105/199.4, 199.1, 105/228, 420; 384/422

[56] References Cited

U.S. PATENT DOCUMENTS

| | | | |
|---|---|---|---|
| 1,202,808 | 10/1916 | Crosti | 105/199.4 |
| 1,900,682 | 3/1933 | Alcott | 105/199.4 |
| 2,150,896 | 3/1939 | Muchnic | 105/199.4 |
| 2,830,166 | 8/1958 | Dieling et al. | 105/199.4 |
| 3,771,465 | 11/1973 | Glenn | 105/199.4 |
| 4,030,424 | 6/1977 | Garner et al. . | |
| 4,108,080 | 8/1978 | Garner et al. . | |
| 4,173,933 | 11/1979 | Kayserling . | |
| 4,196,671 | 4/1980 | Herring, Jr. et al. . | |
| 4,211,311 | 7/1980 | McMullen | 188/209 |
| 4,238,006 | 12/1980 | Jackson et al. | 188/59 |
| 4,242,966 | 1/1981 | Holt et al. . | |
| 4,252,068 | 2/1981 | Nolan | 105/420 |
| 4,289,077 | 9/1981 | Kleykamp et al. | 105/199.4 |
| 4,434,720 | 3/1984 | Mulcahy et al. . | |
| 4,706,571 | 11/1987 | List | 105/168 |
| 4,819,566 | 4/1989 | Smith et al. | 105/199.4 |
| 5,000,097 | 3/1991 | List | 105/167 |
| 5,005,489 | 4/1991 | Terlecky | 105/158.2 |
| 5,024,166 | 6/1991 | Ahlborn et al. | 105/453 |
| 5,039,071 | 8/1991 | Irle et al. | 267/52 |
| 5,046,866 | 9/1991 | Mulcahy | 384/423 |
| 5,083,513 | 1/1992 | Kobayashi | 105/168 |
| 5,138,954 | 8/1992 | Mulcahy | 105/199.3 |
| 5,386,783 | 2/1995 | Rhen et al. | 105/199 |
| 5,410,968 | 5/1995 | Hawthorne et al. | 105/206.1 |
| 5,438,934 | 8/1995 | Goding | 105/199.3 |

OTHER PUBLICATIONS

Car and Locomotive Cyclopedia of American Practices, Association of American Railroads–Mechanical Division (1974) pp. S4–6, S4–7, S8–24, S8–25.

*Primary Examiner*—S. Joseph Morano
*Attorney, Agent, or Firm*—Edward J. Brosius; F. S. Gregorczyk; Stephen J. Manich

[57] ABSTRACT

A connection between a draft sill and a railway wheel truck is disclosed. The draft sill has a bottom and side walls extending up from the bottom. A center pin extends downward from the bottom to an exterior end surface. A boss encircles the center pin. The boss is attached to the outer surface of the center pin and to the bottom surface of the draft sill. The boss includes a plurality of ribs extending radially outward from the center pin. The total surface area of the horizontal surfaces of the boss and the center pin is less than the surface area of a standard center plate. The horizontal surfaces of the boss and center pin do not bear any vertical load under normal conditions, and no center plate is provided. The center pin and boss can be integral, and can be made to extend upward from the truck bolster to be received in an opening in the draft sill.

70 Claims, 6 Drawing Sheets

DRAFT SILL AND WHEEL TRUCK CONNECTION

FIELD OF THE INVENTION

The present invention relates to connection assemblies between cast draft sill structures and railroad wheel trucks.

BACKGROUND OF THE INVENTION

Prior art railroad cars have employed cast draft sill structures, and have included cast draft sills supported on a pair of trucks. Trucks are wheeled structures that ride on tracks and two trucks are normally used beneath each railroad freight car body. Typically, the trucks are "three-piece": two sideframes are positioned parallel to the wheels and the rails and a single bolster transversely spans the distance between the side frames. At each bolster's midpoint is a center plate that carries the weight of the railroad freight car. The center plates are at the interconnections of the railroad freight car bodies and the trucks and permit relative rotation between them so that the trucks may turn as the railroad freight car negotiates curved track. The center plates generally have been flat, horizontal circular plates connected to the railroad freight car body and held within shallow mating bowls centered on the truck bolsters. The bowls have flat, horizontal, circular bearing areas surrounded by annular shallow vertical walls or rims. These mating flat surfaces carry the vertical load at the centers of the bolsters, that is, the weight of the railroad freight car body and its contents are carried at the center of each of the truck bolsters. Truck bolsters have necessarily been of heavy construction, to support the weight of the railroad freight car and to limit stress from the vertical load carried at the centers of the truck bolsters. Horizontal forces to move the truck or slow the load-carrying compartment in response, for example, to draft, buff and braking, act on the shallow edges of the plates and annular vertical walls. Kingpins generally pass through kingpin holes in the body center plates and truck center plate bowls, although the kingpins do not usually serve as pivots, and serve as safety mechanisms to keep the railroad freight car body bolster on the truck bolster, and to guide the body center plates back onto their proper positions on the truck center plates should buff and draft impacts cause misalignment.

In the prior art, the car body center plates have been made as integral parts of the draft sill end castings, shown in one embodiment in the 1974 edition, page S8–25 of the Car Builder's Cyclopedia. Body center plates have also been made as removable center filler plates, as disclosed in U.S. Pat. No. 4,252,068 to Nolan (1981).

Continued attempts have been made to decrease the weight of the cars to allow for reduced energy consumption and more efficient rail transport. It has been desirable to produce railroad freight car components that are relatively lightweight and that can accommodate new car designs. For example, the art has redesigned components such as the truck sideframes, as in, for example, U.S. Pat. No. 5,410,968 (1995) to Hawthorne et al., which discloses a Lightweight Fatigue Resistant Railcar Truck Sideframe with Tapering I-Beam Construction.

In addition, problems that have continued to arise in use of freight railroad freight cars have been so-called "rock and roll" and "hunting". "Rock and roll" refers to the fact that the railroad freight car body is subject to adversely roll from side to side during operation. "Hunting" refers to the fact that under certain dynamic conditions, the truck may tend to adversely oscillate or "hunt" in a yaw-like manner beneath the car body. Both of these conditions of lateral instability of traditional railroad freight car designs have previously been addressed through the use of side bearings, but problems with lateral instability remain.

Moreover, in traditional railcar and truck designs, the center of gravity of the freight car particularly when loaded is relatively high so that when the car encounters impact or buff situations, one end of the railroad freight car bodies may tend to raise and dislodge from the truck so that the center plates may come out of contact with the receiving center plate bowls. Kingpins have traditionally been used as a safety feature to avoid or remedy this problem, but could become damaged during extreme impacts.

SUMMARY OF THE INVENTION

The present invention addressed the need to reduce the weight of a railroad freight car draft sill end casting without reducing the carrying capacity of the railroad freight car. It also reduces the risk of a railroad freight car body becoming separated from its car trucks under draft and buff impact. In some embodiments, the present invention generally increases the area of contact between the railroad freight car body and car truck for transmission of horizontal forces for relative movement and slowing of the car body and the truck. Use of the present invention allows for carrying the vertical load, that is, the weight, of the load-carrying compartment at locations spaced from the connection between the draft sill and the truck, and increases the lateral stability of the railroad freight cars, reducing the risk and rock and roll and hunting.

In one aspect, the present invention provides an improved draft sill for mounting a railroad car on a railway wheel truck, the draft sill being of the type having an exterior surface, an interior on one side of the exterior surface and an exterior on the other side of the exterior surface. The improved draft sill includes a center pin extending outward from the exterior surface of the draft sill for mounting the railroad car on the railway wheel truck and for moving the railway wheel truck with movement of the railroad car and for slowing movement of the railroad car with braking of the railway wheel truck. The center pin has an exterior end spaced from the exterior surface of the draft sill. The draft sill also includes an exterior means for bracing the center pin. The exterior means for bracing the center pin is secured to the draft sill and provides bracing to the center pin at a position spaced from the exterior surface of the draft sill and spaced from the exterior end of the center pin.

In another aspect, the present invention provides, in a railroad car of the type having a load-carrying portion on a draft sill mounted on a railway wheel truck carrying a vertical load from the load-carrying portion, the railway wheel truck being of the type with a truck bolster extending between two sideframes to which the draft sill is pivotally connected, an improved connection assembly for connecting a draft sill and truck bolster comprising a center pin and a boss. The a center pin extends between the draft sill and the truck bolster for pivotally connecting the draft sill to the truck bolster. The boss is positioned between the draft sill and the truck bolster. The boss has an inner portion, at the outer surface of the center pin and an outer portion horizontally and vertically spaced from the inner portion. The center pin and boss are free from the vertical load of the load-carrying portion when the railroad car is at rest.

In another aspect the present invention provides an improved draft sill for mounting a railroad car on a railway wheel truck. The draft sill is of the type having an interior and an exterior, and includes a center pin extending out from the draft sill for mounting the railroad car on a railway wheel truck and having a central longitudinal axis and an exterior end exterior to the draft sill. A brace is secured to the center pin at a position spaced from the exterior end of the center pin.

In another aspect, the present invention provides a draft sill comprising a surface, and a center pin extending out from the surface. A cylindrical ring encircles the center pin and has an annular surface attached to the outer surface of the center pin. The annular surface is spaced from the surface of the draft sill. A plurality of ribs extend radially outward from the cylindrical ring and are integral with the cylindrical ring and integral with the surface of the draft sill.

In yet another aspect, the present invention provides a draft sill comprising an exterior surface and a boss extending outward from the exterior surface of the draft sill. The boss has an outer limit at the exterior surface of the draft sill and an inner limit vertically and horizontally spaced from the outer limit. A center pin is integral with the boss and extends outward from the inner limit of the boss to a free end. The inner limit of the boss is between the free end of the center pin and the exterior surface of the draft sill.

In yet another aspect, the present invention provides a railroad car truck bolster for supporting a load-carrying compartment of a railroad car on a pair of wheel sets. The bolster comprises a top surface, a boss extending outward from the top surface of the bolster, and a center pin extending outward from the boss to a free end. The boss has an inner limit at the center pin and an outer limit vertically and horizontally spaced from the inner limit. The outer limit is at the top surface of the bolster and the inner limit is between the top surface of the bolster and the free end of the center pin.

DETAILED DESCRIPTION

Figure 1:
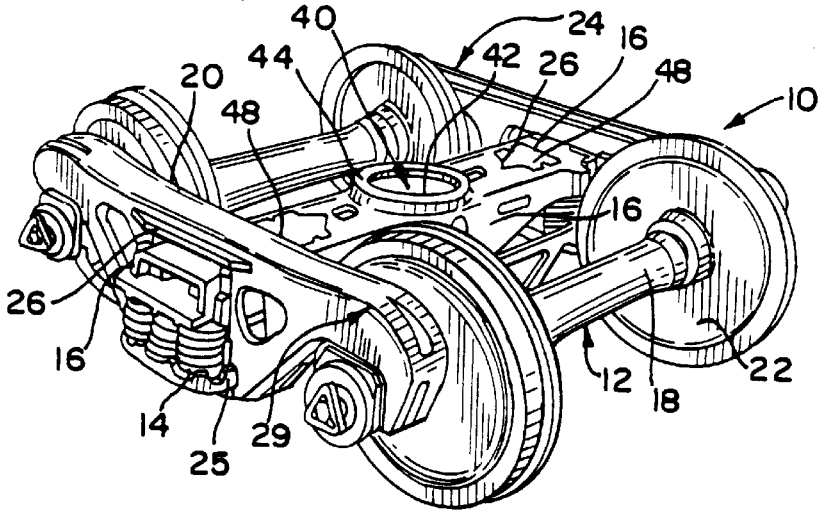
FIG. 1 PRIOR ART
FIG. 1 is a perspective view of a prior art railway truck.

Referring to FIG. 1 there is shown a railway vehicle truck 10 common to the railroad industry. Generally, truck 10 comprises a pair of longitudinally spaced wheel sets 12, each set including an axle 18 with laterally spaced wheels 22 attached at each end of the axles 18 in a standard manner.

A pair of transversely spaced sideframes 20, 24 are mounted on the wheel sets 12. Sideframes 20, 24 each include a bolster opening 26, respectively, in which there are spring sets 14 to support the ends of a bolster 16. Bolster 16 extends laterally between each sideframe 20, 24 and generally carries the weight of the railroad freight car. Upon movement in the vertical direction, bolster 16 is sprung by spring groups 14 which are seated on a spring seat plate or flange 25 at the bottom of each sideframe 20, 24. The prior art bolster is of substantially standard construction, as will be understood by those in the art.

Figure 2:
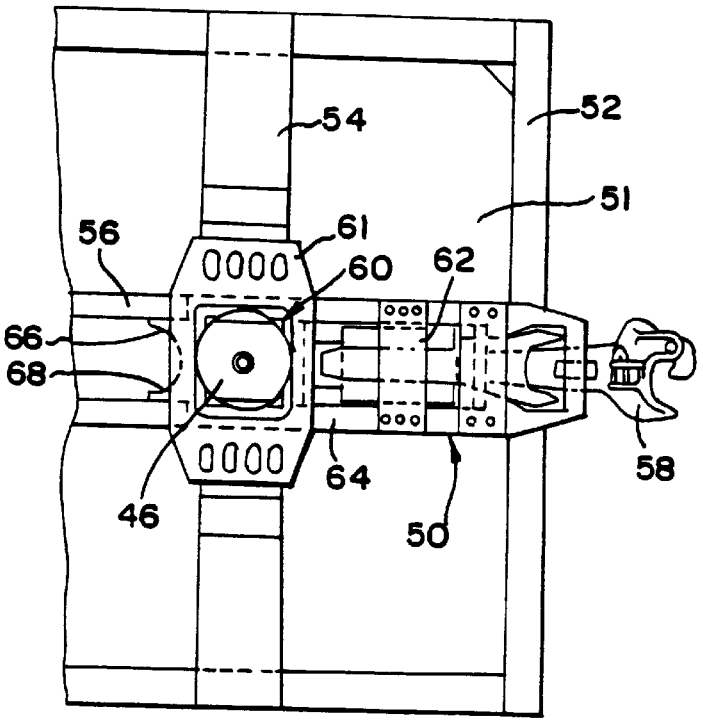
FIG. 2 PRIOR ART
FIG. 2 is a bottom view of a prior art railroad freight car body with a prior art draft sill and coupler in place.
Figure 3:
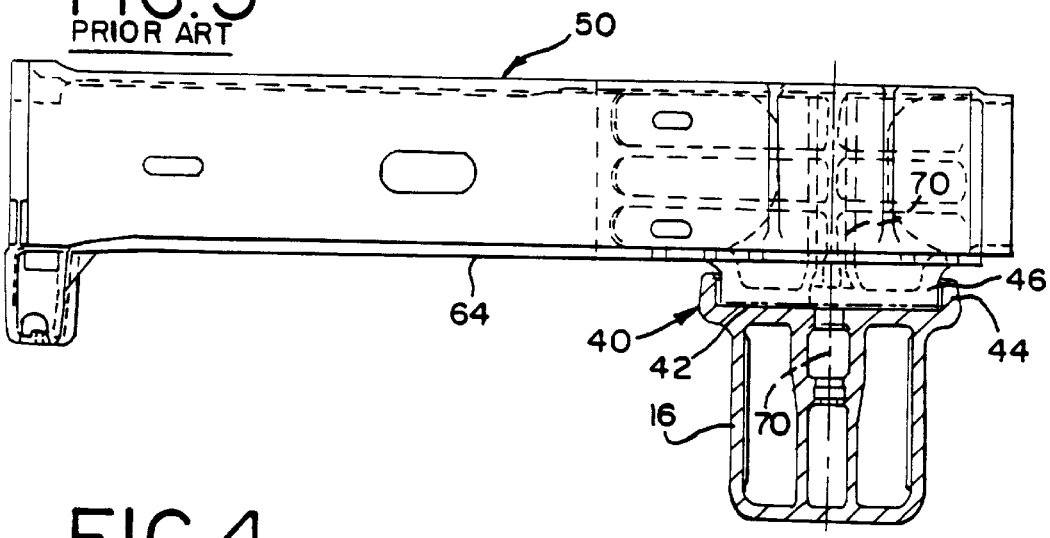
FIG.3 PRIOR ART
FIG. 3 is a side elevation of a prior art draft sill, shown mounted on a prior art railway truck bolster which is shown in cross-section and with parts removed for illustration.

As seen in FIGS. 1 and 3, the bolsters 16 of the prior art trucks 10 typically included a truck bolster center plate bowl 40, comprising a flat, horizontal circular bearing area 42 surrounded by a shallow annular vertical center plate rim 44 to define a shallow bowl. A mating car body center plate 46, shown in FIGS. 2 and 3, is received and held in this shallow bowl. The truck bolster center plate 40 may rotate with respect to the car body center plate 46 so that the truck may turn to negotiate curves in the track. As shown in FIG. 1, outboard from the truck bolster center plate 40 may be a pair of side bearings 48.

Two examples of prior art railroad freight car body center plates 46 are shown in FIGS. 2 and 3. FIG. 2 shows a cast draft sill 50 mounted to the structure of a railroad freight car 51. In this mounted position the cast draft sill 50 is secured to the end sill 52, the body bolster 54 and the center sill 56. The illustrated cast draft sill has draft gear mounted within the draft gear pocket and the coupler 58 has its shank extend through the coupler shank opening at the outboard end thereof. A center filler plate, indicated generally at 60, is mounted in the center filler plate pocket of the cast draft sill by welding. The center filler plate 60 includes the car body center plate 46. A sole plate 61 connects the body bolster 54 over the cast draft sill 50. The draft gear pocket of the cast draft sill has a pair of draft gear carrier members 62 mounted transversely thereto below the draft gear cushioning unit. The draft gear carrier members are connected to bottom flanges 64 of the draft sill. The end of the illustrated cast draft sill includes a fish-tail plate 66 that has a generally U-shaped opening 68; the fish tail plate has a pair of facing horizontally disposed fillets that function to transmit and distribute forces from the cast draft sill to sides of the center sill 16 when the fillet plates and lip are welded to the railroad car center sill.

Other prior art center plates include those that are cast integral with the draft sill, as shown in FIG. 3, where like numbers have been used to refer to like parts. The draft sill 50 of FIG. 3 is for use with Type "F" couplers. In such typical designs, the car body center plate 46 may extend about 3.31 inches from the bottom 64 of the draft sill 50, and have a diameter of about 15.875 inches. Other possible dimensions familiar to those skilled in the art include a 13.875 inch diameter car body center plate extending down from the draft sill about two and five-eighths inches and an 11.875 inch diameter center plate. The diameter of the truck bolster center plate bowl is slightly larger to receive the body center plate and allow it to turn and may typically be 16, 14 or 12 inches in diameter to mate with an appropriately-sized center plate. The illustrated truck bolster 16, its center plate 40, and the draft sill 50 and its center plate 46 include coaxial king pin bores 70 to receive a king pin, as is typical in the art.

The draft sill of the present invention is shown in FIGS. 4–8 and 11–15. As there seen, many of the upper structures of the draft sill, especially the area receiving the coupler, may be similar to or the same as those known in the art for cast draft sills. Suitable upper structures include that shown in FIG. 3 and that shown in U.S. Pat. No. 4,252,068 (1981) to Nolan; the entire disclosure of U.S. Pat. No. 4,252,068 is fully incorporated by reference herein.

The present invention departs from the prior art draft sill structure in providing a unique means for mounting the railroad freight car body to the truck bolster, a unique means that allows for use of a lighter, more efficient bolster and for more stable support of the railroad freight car body on the truck. In the present invention, the horizontal and vertical loading of the truck are separated, and the center plates have been eliminated and the draft sills mounted on a truck through a center pin that is braced against horizontal forces and moments.

Figure 4:
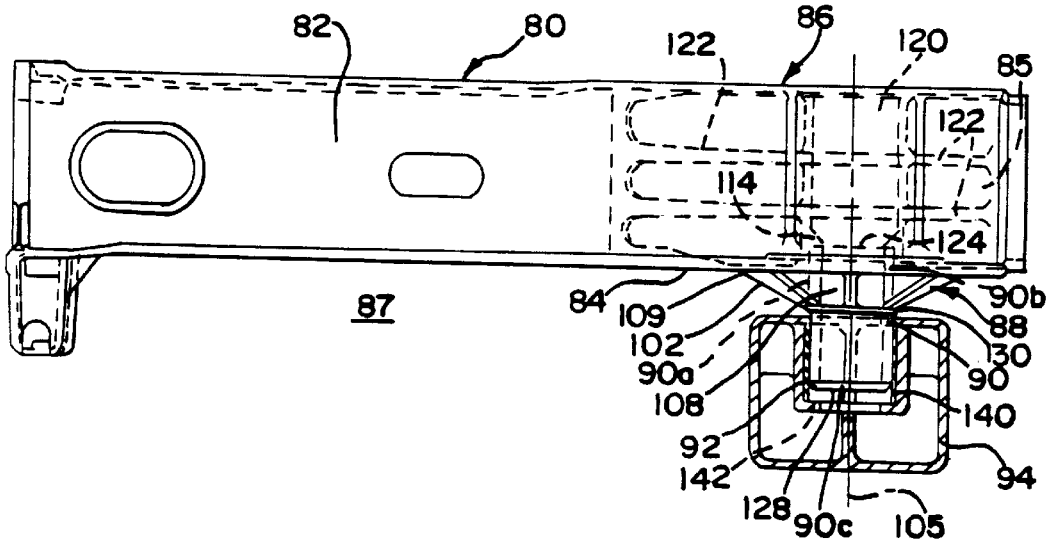
FIG. 4 is a side elevation of a first embodiment of the draft sill of the present invention, shown mounted on a truck bolster which is shown in cross-section, with the side frame and wheels removed for clarity of illustration.
Figure 5:
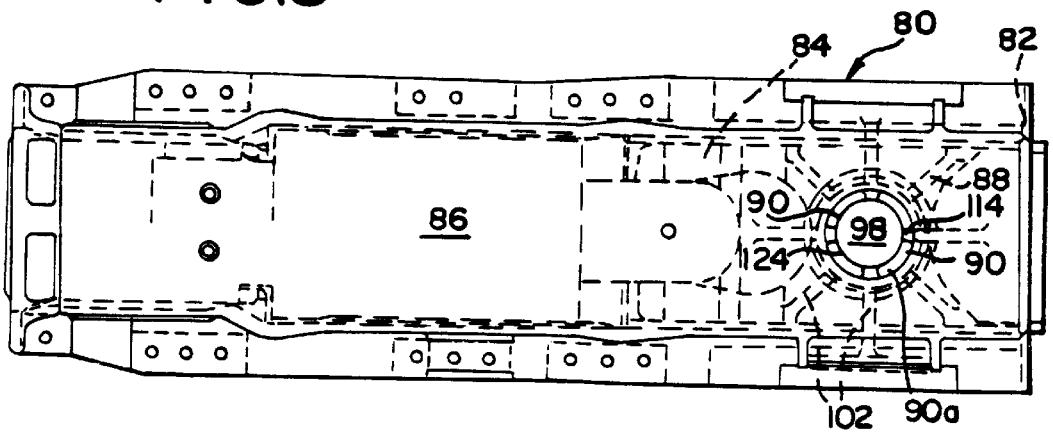
FIG. 5 is top plan view of a first embodiment of the draft sill of the present invention, shown removed from the truck bolster.

As shown in FIGS. 4 and 5, one embodiment of the draft sill 80 of the present invention is a cast draft sill including side walls 82 and an exterior surface or bottom wall 84 that may extend laterally beyond the side walls 82. The first illustrated draft sill 80 also has a top wall 86, an interior 85 between the top and bottom and side walls and an exterior 87 beyond the top, bottom and side walls. The draft sill has a boss 88 extending downward from the exterior surface or bottom wall 84 of the draft sill. To mount the draft sill on a railway wheel truck 89, a center pin or tube 90 has a cylindrical portion 90*a* that is received and held by the boss 88, a coaxial portion 90*b* that is received and held within the interior of the draft sill, and a coaxial cylindrical portion 90*c* that is received and held within a cylindrical receiving cavity 92 in the truck bolster 94. The center pin or tube 90 is rotatable within the cavity 92 so that the truck bolster 94 may turn as it traverses curved track. The illustrated center pin 90 and boss 88 comprise an improved connection assembly 91 for connecting a draft sill 80 and truck bolster 94 of a railroad car.

Figure 6:
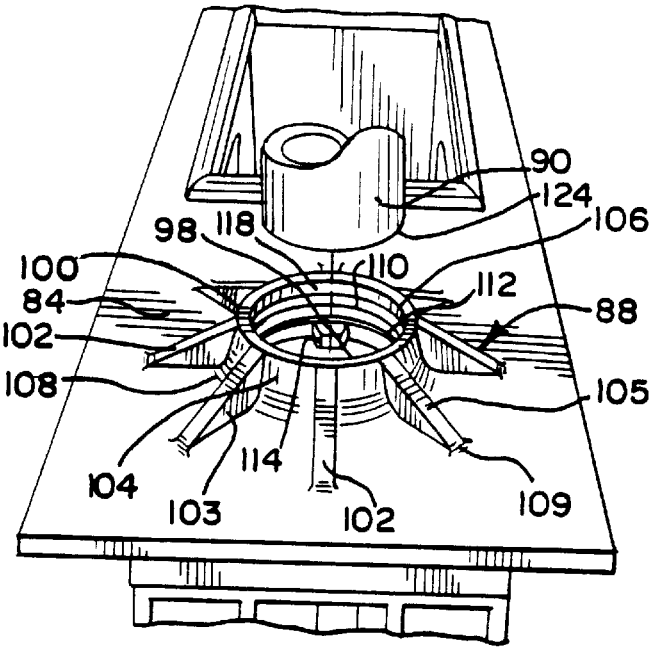
FIG. 6 is a partial perspective view from one end of the first embodiment of the draft sill of the present invention, with the bottom side of the draft sill facing upward and with the center pin removed for illustration.
Figure 7:
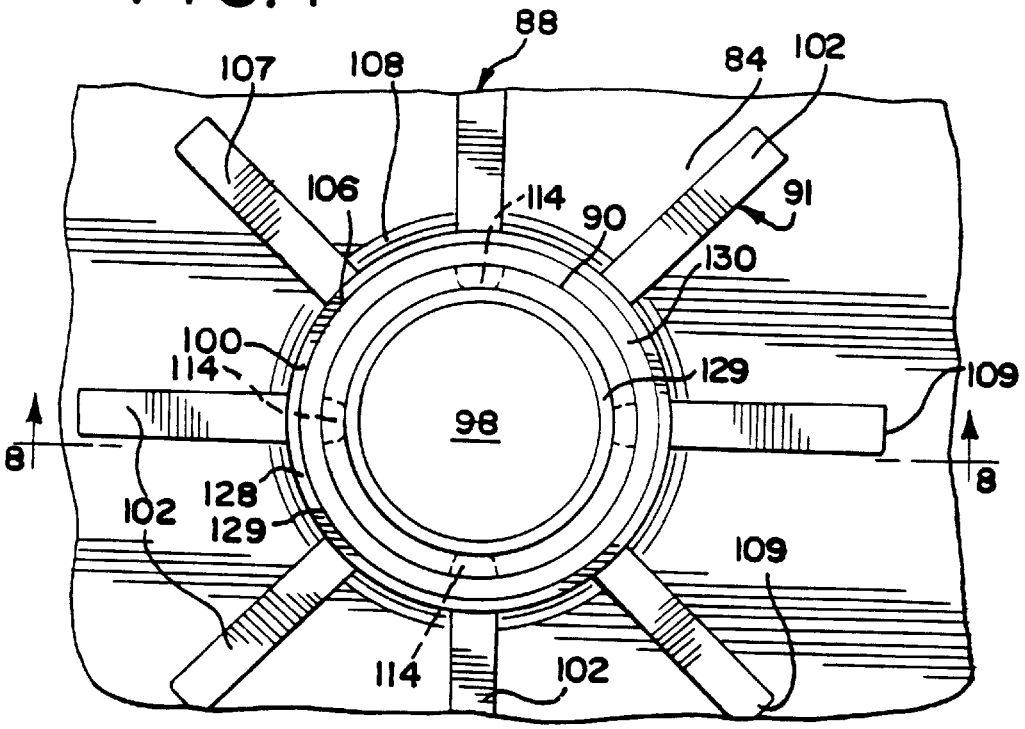
FIG. 7 is a partial bottom plan view of the boss, center pin and draft sill of the first embodiment of the draft sill of the present invention.
Figure 8:
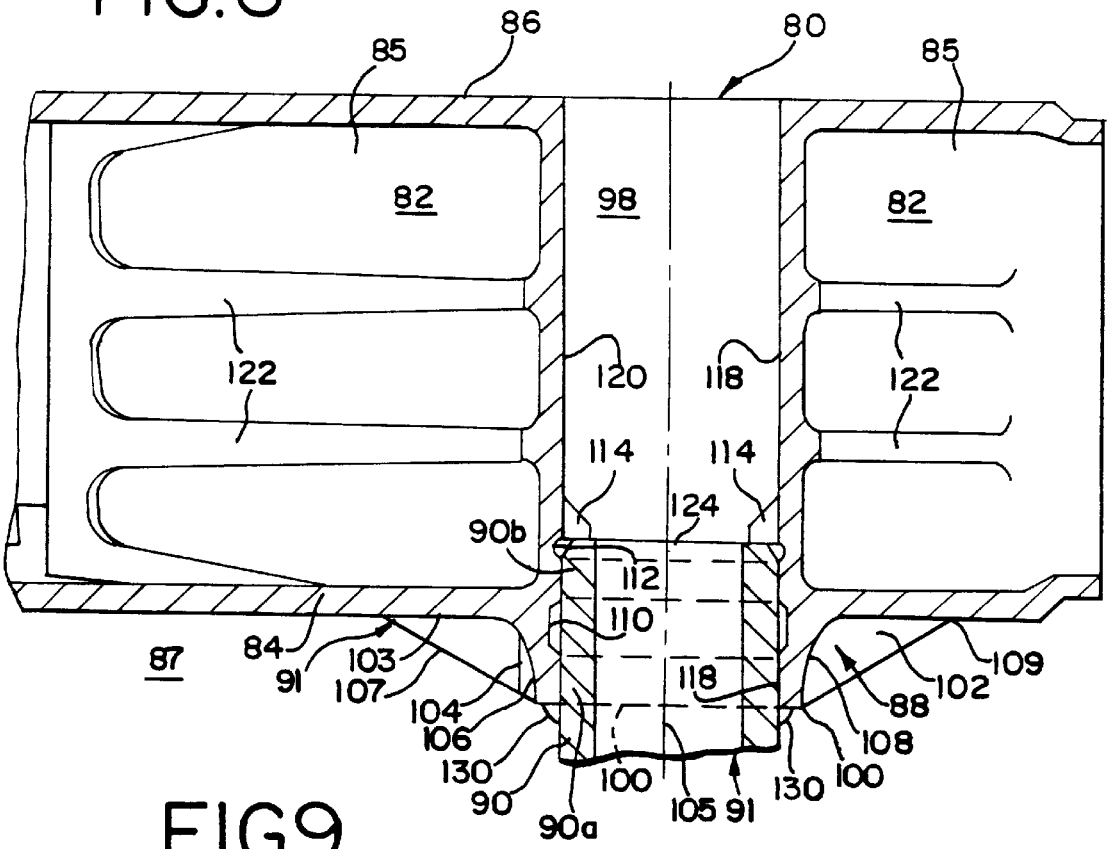
FIG. 8 is an enlarged partial cross section of the first embodiment of the draft sill of the present invention, taken along line 8—8 of FIG. 7.

As shown in FIGS. 4, 6 and 8, the first embodiment of the boss 88 of the present invention extends downward from the bottom wall or exterior surface 84 of the draft sill, defining a cylindrical cavity 98 (see FIGS. 5–8) and terminating in an annular surface 100 that is parallel to the bottom wall 84. In the illustrated embodiment, the annular surface 100 is about 2.44 inches below the bottom wall 84 and has an outer diameter of about 7.25 inches and an inner diameter of about six inches. A plurality of spaced ribs 102 extend from this annular surface 100 to the bottom wall 84 of the draft sill 80.

As shown in FIGS. 6 and 7, the illustrated embodiment includes eight ribs 102 evenly spaced around the circumference of the annular surface 100. Each rib 102 in the illustrated embodiment is shaped, in cross section, as a right triangle, with a longer leg 103 along the bottom wall 84 of the draft sill and its shorter leg 104 extending perpendicularly down from the bottom wall 84 of the draft sill to the annular surface 100, parallel with the central longitudinal axis 105 of the cylindrical draft sill cylindrical cavity 98. The shorter leg 104 of each rib 102 is disposed along a substantially cylindrical ring 106 defined by the annular surface 100 of the boss 88.

The ribs 102 extend radially outward from the outer edge of the annular surface 100, or from the cylindrical ring 106 spaced at 45 degree angles from each other. Each rib may be about three-quarters of an inch wide, and has an outer surface that defines an angle of about 29 degrees with the annular surface 100, or about 61 degrees with the central longitudinal axis 104 of the cylindrical opening 98. The lateral distance from the outer diameter of the annular surface 100 to the outer limit 109 of the boss at the connection of each rib 102 to the bottom wall 84 of the draft sill may be about 4.38 inches in the illustrated embodiment, and the vertical distance between the bottom wall 84 of the draft sill and the end of the rib at the annular surface 100 may be about 2.44 inches so that the length of each outer rib surface 107 is about 5.01 inches in the illustrated embodiment. Thus, the boss 88 may have one portion, comprising the annular surface 100 at the outer surface of the center pin 90 and defining an inner limit, and another portion comprising the outer limit 109 horizontally and vertically spaced from the first portion. The particular dimensions and numbers and shapes of ribs are for purposes of illustration only; other dimensions and numbers and shapes of ribs may be used and are within the scope of the present invention.

In the interstices 108 between adjacent ribs 102, cast metal may smoothly connect the annular surface 100, adjacent ribs 102 and the bottom wall or exterior surface 84 of the draft sill 80. However, the interstices could be left open. In the illustrated embodiment, the bottom wall or exterior surface 84 is shown as extending between the side walls, but it should be understood that it need not connect the side walls.

The boss comprises an exterior means for bracing the center pin. It provides bracing at the juncture of the annular surface 100 and the center pin 90, a position spaced from the bottom wall or exterior surface 84 of the draft sill 80 and spaced from the free exterior end 128 of the center pin 90.

In the first illustrated embodiment, as shown in FIG. 8, the interior of the draft sill cylindrical cavity 98 includes annular indentations 110, 112, coaxial with the central longitudinal axis 104 of the opening 98 and spaced between the annular surface 100 and four stops 114 spaced evenly about and integral with the interior wall 118 of the cylindrical opening 98. As seen in FIG. 8, the illustrated cylindrical opening 98 and cylindrical interior wall 118 extend from the annular surface 100 upward to the top wall 86 of the draft sill to define a hollow cylindrical interior receiving tube 120 extending to the top surface 86 of the draft sill. The illustrated draft sill 80 includes a plurality of longitudinal support ribs 122 to further brace the cylindrical interior receiving tube 120 against horizontal loads and bending moments.

As shown in FIGS. 4, 5 and 8, a portion 90*b* of the central pivot pin or tube 90 is received and held within the interior receiving tube 120 of the draft sill 80. The center pin 90 has one end 124 that abuts against the stops 114 within the interior of the receiving tube 120 and an opposite end 128 extending downward past the annular surface 100. In the illustrated embodiment, the draft sill interior receiving tube 120 is dimensioned and the stops 114 positioned so that the distance between the annular surface 100 and the interior end 124 of the center pin or tube 90 at the stops 114 is about 4.250 inches and the distance between the annular surface 100 and the opposite end 128 of the tube 90 is about 5.88 inches. Thus, the end 124 of the center pin 90 is within the interior of the draft sill. The illustrated central pivot pin or tube 90 has an outer diameter of about six inches walls and an interior diameter of about four and one-half inches. Its outer diameter is held tightly within the draft sill tube 120, preferably without any slack for movement in any direction, so that the center pin 90 is braced against buff and draft forces, other lateral forces and moments, and is substantially free from horizontal movement.

To provide the desired tight fit between the center pin 90 and the draft sill interior tube 120 in a cast device, it is likely that machining of the interior wall 118 of the receiving tube 120 will be required. To reduce the amount of machining required, the annular indentations 110, 112 are formed in the interior wall 118 of the receiving tube 120 so that only parts of the interior wall 118 bear against the inserted pivot tube or pin 90 and only those parts need be machined.

As shown in FIGS. 4 and 8, the center pin 90 is preferably welded to the boss 88 at the juncture of the pin 90 and the annular surface 100 along an annular weld 130 so that loads may be transferred from the pin to the boss. It may also be desirable to weld the tube or pin 90 to the boss at other locations. For such additional welding, bores, cut-outs or openings could be provided in the interstitial areas 108 to provide access for welding the center pin 90 to the interior wall 118 of the draft sill receiving tube 120.

Figure 14:
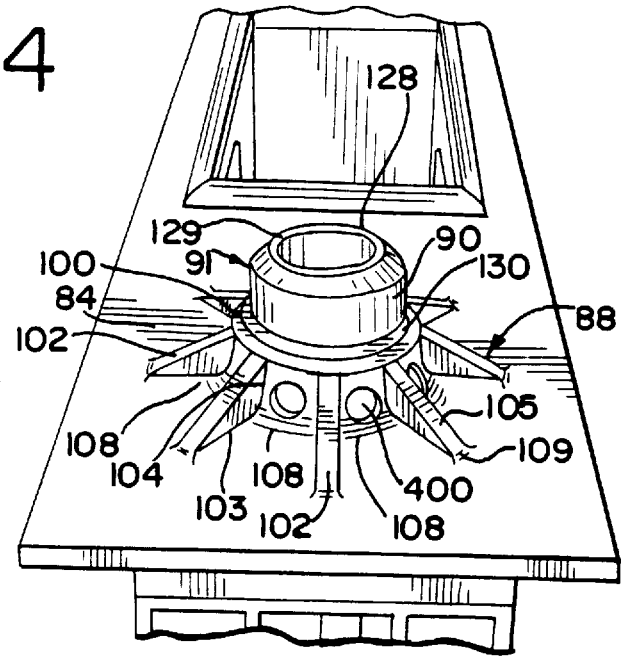
FIG. 14 is a is a partial perspective view from one end of the another embodiment of the draft sill of the present invention, with the bottom side of the draft sill facing upward and with the center pin attached to the boss through holes in the boss.
Figure 15:
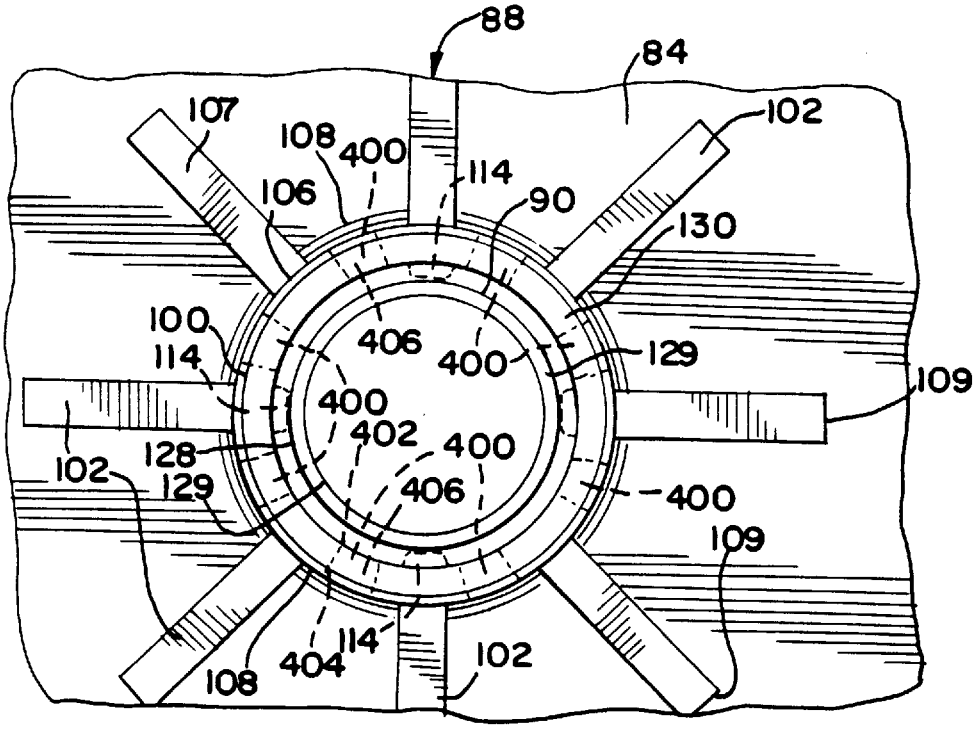
FIG. 15 is a partial bottom plan view of the boss, center pin and draft sill of the embodiment of the draft sill of FIG. 14.

Examples of such bores, cut-outs or openings and additional welding are illustrated in FIGS. 14 and 15. As there shown, there are generally circular cutouts 400 provided in the interstitial areas 108 between the ribs 102 in the cylindrical ring 106 . These cut-outs or holes 400 provide an edge 402 or surface 404 that may be attached or secured to the outer surface of the center pin 90 by welds 406. In the illustrated embodiment, each cutout or opening 400 is about one and one-quarter to one and one-half inches in diameter, with the centers of the openings or holes spaced about one and one-half inch from the annular surface 100. Each cutout or opening may be formed as part of the casting, although they could be machined in place after casting. The welds 406 may extend around the entire edge 402 of each cut-out or opening 400 and may fill the entire opening to form an auxiliary plug weld. Alternatively, the boss could be attached to the center pin between the ribs with bolts. Thus, the center pin 90 may be attached or secured to the boss 88 at positions between the inner limit 100 of the boss and the outer limit 109 of the boss.

Both ends 124, 128 of the center pin 90 may be chamfered for ease of insertion into the receiving tube 120 and the cylindrical cavity 92 in the truck bolster 94. The interior mating surface at the juncture of the stops 114 and the interior wall 118 may be similarly chamfered for alignment of the parts.

Figure 9:
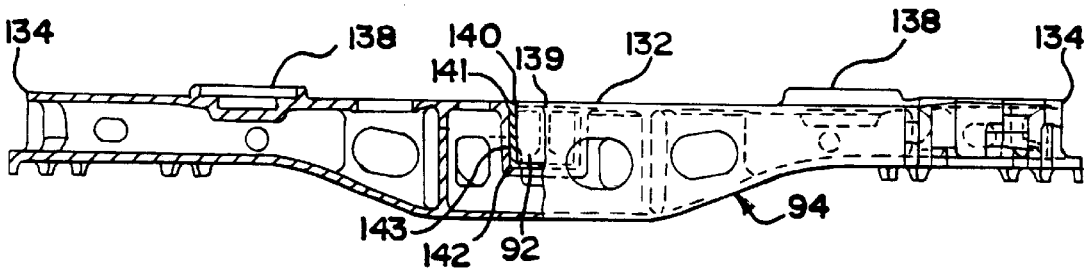
FIG. 9 is a side elevation of a railway truck bolster that may be used with the draft sill of the first embodiment of the present invention, with the left half shown in cross-section.
Figure 10:
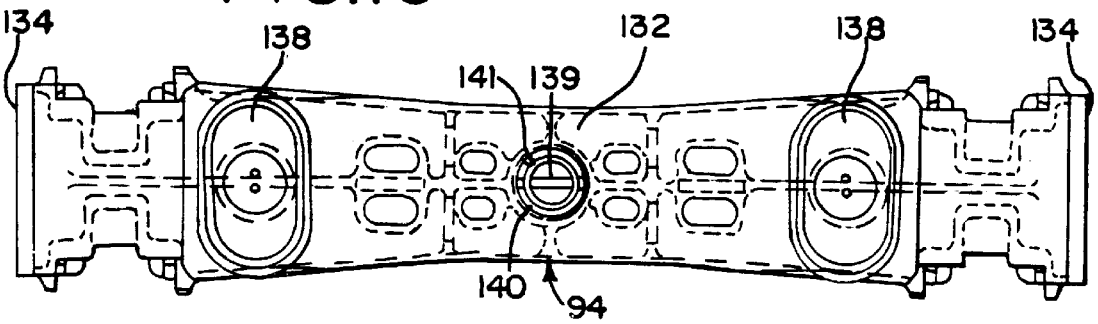
FIG. 10 is a top plan view of the railway truck bolster of FIG. 9.
Figure 11:
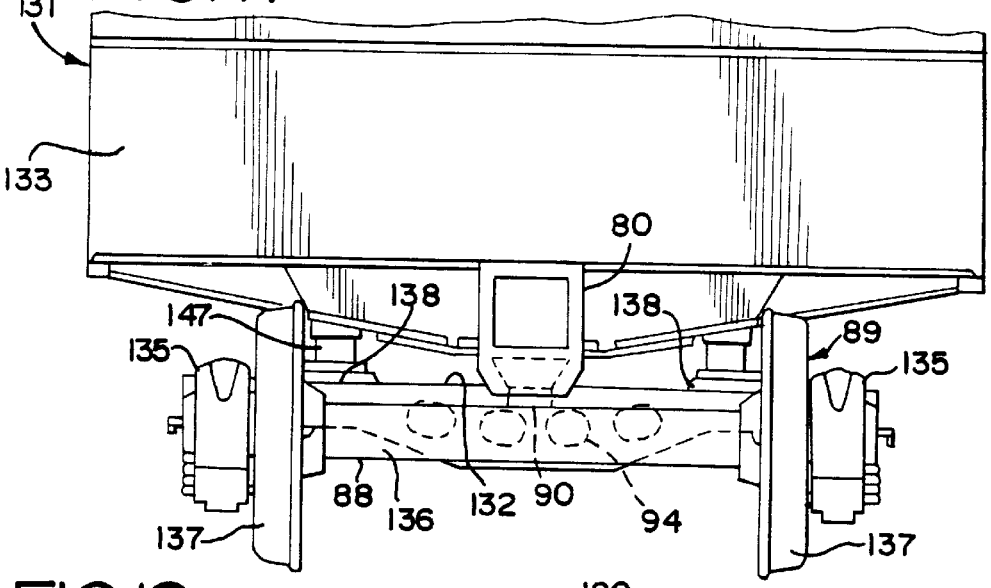
FIG. 11 is a partial front elevation of a railroad car utilizing an embodiment of the draft sill of the present invention.

An example of a suitable truck bolster 94 for use with the first embodiment of the present invention and its cylindrical receiving cavity 92 are illustrated in FIGS. 4, 9 and 10. As there illustrated, the first illustrated truck bolster 94 has a top surface 132 and ends 134 that are received within side frames 135. Suitable side frames 135 are within the art and may be of the type shown in the FIG. 1 prior art drawing or as shown in FIG. 11, mounted on standard axles 136 and wheels 137. At its center 139 the truck bolster top surface has a circular opening 141 into the receiving cavity 92.

The bolster 94 used with the first embodiment of the present invention does not have a center plate structure for receiving the vertical load of the railroad freight car. Instead, the vertical load is carried by the bolster at positions remote from the connection between the center pivot pin or tube 90 of the draft sill and the receiving opening 92 of the truck. In the present invention, the vertical load is carried at the side bearings 138 on the top 132 of the bolster (See FIGS. 9–11).

Any suitable or desirable side bearings may be used. An example of side bearings that may be used in the present invention are those disclosed in U.S. Pat. No. 5,046,866 (1991) to Mulcahy entitled "Multifriction Side Bearing for a Railcar Truck" and assigned to Amsted Industries, Inc., the disclosure of which is fully incorporated by reference herein, although it should be understood that other side bearings may be used. The side bearings bear the load of the weight of the railcar and may be structurally reinforced to bear that load. The pads 147 on the railcar body bolster as shown in FIG. 11 may be made of anything strong enough to carry the weight of the body bolster, such as an appropriately sized structural tube, strong enough to carry the weight of the car; the appropriate characteristics for the structural tube may vary depending on car design factors, such as the capacity of the car.

Because the vertical load in the present application is not carried at one point or area at the center of the truck bolster, but instead at the side bearings, between the center of the bolster and the ends of the bolster, at two spaced points or areas, there should be less tendency for the bolster to bend at its center, requiring a less heavy bolster for use. Any suitable or desirable truck bolster may be used with the present invention. An example of a suitable bolster for use with the present invention is that shown in FIGS. 9–10, although it should be understood that the draft sill boss and center pin may be used with any suitable or desirable bolster that will or is adapted to receive or support a center pin as shown in the accompanying drawings. Another suitable truck bolster is that shown in U.S. Pat. No. 5,138,954 (1992) to Mulcahy and assigned to Amsted Industries, Inc., entitled "Freight Railcar Truck and Bolster for Outboard Support of Car Body with Side Bearings Located Entirely Outside of the Sideframes for Receiving the Entire Vehicle Weight", the entire disclosure of which is incorporated by reference herein.

In the illustrated embodiment, the bolster's receiving cavity 92 is defined by a wall 143 extending down from the circular opening 141 in the top surface 132 of the bolster to an annular bottom surface or wall 142. Preferably, the receiving cavity 92 in the bolster 94 has a cylindrical insert or liner 140 to reduce friction between the bolster and the pivot tube 90 when the truck turns about the axis of rotation 104 when negotiating a curve. Preferably, the outer surface of the center pin 90 is in contact with the inner surface of the insert 140, and the outer surface of the insert 140 is in contact with the inner surface of the receiving opening 92 so that there is little or no horizontal slack. The illustrated insert is open at both ends, although it may be desirable for the insert 140 to have a smooth edge that extends over part of the top 132 of the bolster to protect the weld 130 from damage should there be any rubbing between the weld and the bolster. In the illustrated embodiment, the top annular edge of the opening 141 is chamfered to receive a small overlap of the liner 140.

The insert may be made of a low-friction polymer and dimensioned to fit tightly within the opening 92 in the top 132 of the bolster 94. The material may be, for example, a self-lubricating polyamide available from Pennsy Corporation of West Chester, Pennsylvania, Pennsy part number 1352; it should be understood that this material is identified for purposes of illustration only; any suitable or desirable liner may be used. As shown in FIG. 4, the depth of the receiving cavity 92 may be great enough so that there is little or no contact between the end 128 of the center pivot tube or pin 90 and the annular bottom surface 142 of the cavity 92. In the first illustrated embodiment, the opening 92 is about six inches deep. In the first illustrated embodiment, the inner diameter of the liner may be about 6.19 inches, leaving substantially no slack between the liner's inner diameter and the 6 inch outer diameter of the center pin 90. Thus, there is very little horizontal slack between the center pin 90 and the truck bolster 94, and thus little slack in the draft sill to truck connection. As in the case of other dimensions given for the illustrated embodiment, these dimensions are given for purposes of illustration only; other dimensions may be used and are within the scope of the invention as claimed.

Similarly, the side bearings 138, which function in this design as the vertical load bearing members, should have a height and capacity to support the draft sill so that the weld 130 is positioned above the top 132 of the truck bolster 94 to protect the weld from wear due to friction with the truck bolster. Stated another way, the side bearings and bolster should be selected, designed and adjusted to carry the entire vertical load of the railroad freight car 131, so that the connection between the railcar 131 and the railway truck at the center pin 90 is substantially free from vertical loading; the vertical loading is instead spaced outboard of the truck bolster center. All of the weight of the load-carrying compartment 133 will then be carried or supported by elements other than the center pin and boss at positions spaced from the center of the truck bolster when the truck is at rest. In such a truck bolster it is not necessary to include a center plate structure or retaining rim as shown in the prior art (see FIGS. 1 and 3); instead, the center of the truck bolster is free from a center plate structure for supporting the weight of the load-carrying compartment when the railroad car is at rest. Such a railroad car mounted on a railway truck should increase the lateral stability of railroad freight cars and reduce the risk of rock and roll and hunting. In addition, since the vertical load is carried at two locations instead of one, spaced from the center of the bolster, a lighter bolster may be used. Thus, with the center pin and boss of the present invention used instead of a center plate, the weight of a railroad freight car draft sill end casting is reduced without reducing the carrying capacity of the railroad freight car.

Since the annular horizontal surface 129 at the free end 128 of the center pin 90 is not a vertical load-bearing surface but is free from vertical loading, the area of the horizontal surface 129 can be relatively small, compared to a conventional center plate. Similarly, annular surface 100 on the boss 88 is not a vertical load-bearing surface and is relatively small compared to a conventional center plate. In the illustrated embodiment, for example, the surface area of the horizontal surface 129 at the end of the center pin is at most about 12 and a half square inches, and less than that if the end surface is chamfered; and the area of the annular surface 100 on the boss is about 15 and a half square inches, totalling about 28 square inches. In contrast, a conventional center plate may have a diameter ranging from about 11.875 to 15.875 inches, with a central bore for a king pin of about 2 to 4 inches, with vertical load-bearing surface areas ranging from about 98–195 square inches, substantially greater than the horizontal surface areas available in the present invention. In the present invention, all horizontal surfaces 100, 129 of the boss 88 and center pin 90 may be free from the vertical load of the load carrying compartment when the railroad car is at rest. Accordingly, the total areas of the surfaces 100, 129 on the exterior means for bracing the center pin and the center pin perpendicular to the central longitudinal axis 105 of the center pin 90 is less than the surface area of a conventional center plate.

Generally, the draft sill in the above-described embodiment may be cast of Grade B steel. The center pin or tube 90 may be cast of the same or of a different material, such as a higher strength steel. 1026 steel may be used for the center pivot pin or tube 90. In selecting the material to use for the center tube or pin 90, the material should be one that can be properly welded to the material used for the cast draft sill and its boss. Generally, the carbon content of the two pieces should be matched for a good weld to be formed between these two members. Preferably, the tube or pin 90 is seamless. Although the pin 90 could be a solid cylinder, to reduce weight a hollow tube may be preferred as illustrated. In the first illustrated embodiment, the center pin 90 has an overall length of 10.130 inches, plus or minus 0.030, an outer diameter of 6.00 inches and an inner diameter of 4.50 inches; these dimensions are for purposes of illustration only, and the invention is not limited to them.

When used with the illustrated boss 88, 4.250 inches of the length of the tube is held tightly within the boss and the interior of the draft sill structure, so that a substantial area of the tube is available for moving the railway wheel truck with horizontal movement of the railcar load-carrying compartment, such as when the railcar is subjected to draft, buff, and normal pushing and pulling forces; and when a braking force is applied to the railway wheel truck, the center pin serves to slow and stop the load-carrying compartment. Thus, as a draft or buff force is applied to the car, the force may be absorbed by the draft sill front and rear stops and transferred to the car body center sill and car structure; the center pin may move the truck along the rails when the car reacts against the buff or draft force. Thus, in the present invention there is a substantial area of contact between the railroad freight car body and car truck for moving the truck and for slowing and stopping the car body. Moreover, given the length of tube 90 held within the truck cylindrical opening 92, the risk of a railroad freight car body becoming dislodged from its car trucks under buff or draft impact is reduced.

Accordingly, the center pin or tube 90 of the present invention should be long enough at its free end 128 to remain in its seated position within the receiving cavity 92 if one end of the car raises during normal use. It should be of sufficient size and material to withstand anticipated horizontal loads, lateral loading from tendencies of the freight car to slip or slide laterally, as well as to withstand anticipated bending moments from tendencies of the freight car to rock and roll and other forces.

It is expected that a pin diameter should be at least six inches to prevent bending under anticipated loads. Although the pin could be of a larger diameter, a larger pin would probably be over-designed and would unnecessarily increase the weight of the draft sill. In the first illustrated embodiment, the length of the pin 90 from the weld 130 to the free end 128 is about five and one-half inches. A smaller diameter and shorter pin could also be used, but a smaller surface area of the pin in contact with the truck bolster liner would likely result in a higher unit pressure, increasing the rate of wear of these components. Having less than about five and one-half inches of the pin received in the truck bolster cavity also increases the likelihood that the pin will come out of contact with the truck bolster. Although the pin could be longer than the illustrated pin, it is not foreseen that a longer pin is necessary.

The ribs 102 and annular surface 100 together comprise an exterior means for bracing the center pin 90. This exterior bracing means provides support of the center pin at a position spaced from the bottom wall 84 of the draft sill 80, and outside of the draft sill. It also provides support outside of the bolster 94 and spaced from the bolster's top 132. It should be understood that other types and shapes of bracing elements or reinforcements could be used and are within the scope of the invention as claimed. For example, a plurality of struts, trusses, brackets or buttress-like bracing elements could be used as a boss to brace the center pin at this exterior location. The bracing elements could have other shapes, such as quarter-circles or quarter-ovals, or could be thicker than illustrated, but retaining a triangular cross-section or strut-like cross-section as well. As used herein, "rib" or "ribs" refers to any such structure that provides for horizontal and vertical distribution of forces. The boss or brace need not be formed of individual separate ribs or bracing elements, but could be solid as well, or somewhere between solid and the illustrated structure. The boss or brace need not be cast in place, but could, for example, be separate elements welded in place after casting.

The center pin 90 is also braced against horizontal forces and bending moments at two other positions by the tight, substantially slack-free fit of the center pin in the cylindrical cavity 98 of the draft sill and the receiving cavity 92 in the bolster 94. There is a draft sill interior bracing means, comprising the tight fit of the interior wall 118 defining the tube 120 against the center pin 90. There is also a bolster interior bracing means, comprising the tight fit of the receiving opening 92, or its liner 140 against the outer diameter of the center pin 90. Both of these interior bracing means are at positions spaced from the outer surfaces of the elements: the draft sill interior bracing means extends to the juncture of the center pin 90 and the inner wall 118 near the top end 124 of the pin 90, which may, for example, be about one inch or more from the outer surface of the bottom wall 84 of the draft sill. The bolster interior bracing means extends along a portion of the length of the center pin to from the bolster's top surface to the opposite exterior end 128 of the center pin 90 within the liner 140 within the receiving bolster cavity 92, which may, for example, extend about five or more inches below the top surface of the bolster 94.

The bracing of the center pin 90 from horizontal forces and bending moments may include means for strengthening the draft sill interior bracing means. In the illustrated embodiment, this strengthening means comprises the extension of the tube 120 to the top 86 of the draft sill and the group of longitudinal support ribs 122 acting against the extension of the tube 120.

In the first illustrated embodiment, the draft sill is cast as in normal casting processes, and then the walls 118 of the opening 98 may be machined to assure a tight fit between the pivot pin or tube 90 and the boss 88. The tube 90 may then be welded in place along the annular juncture of the tube wall and the annular surface 100 of the boss 88, as shown at 130.

Figure 12:
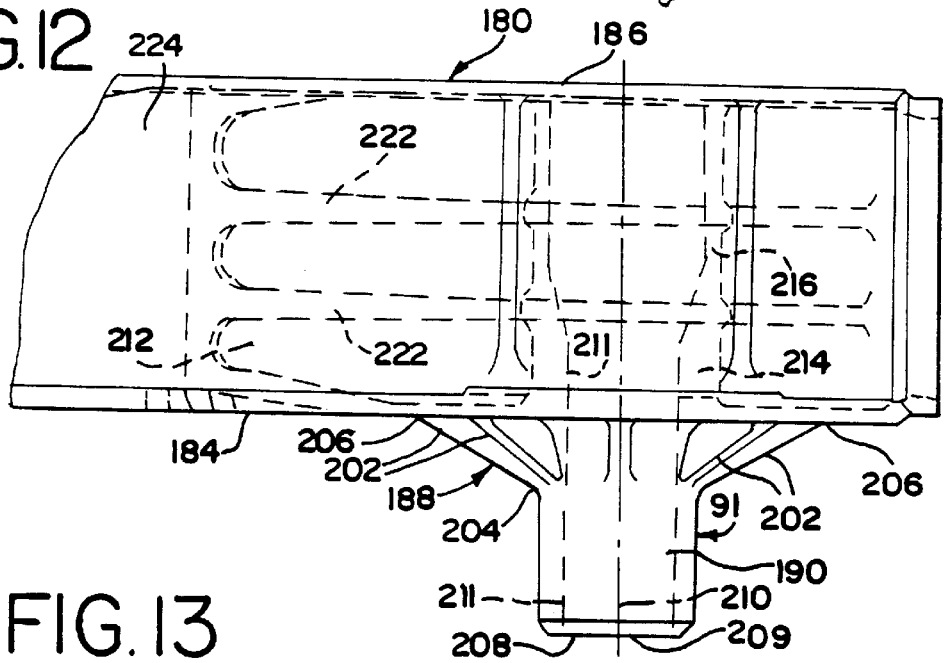
FIG. 12 is a side elevation of an alternative draft sill of the present invention.

As an alternative to the above-described embodiment, it may be desirable to cast the boss, draft sill and center pivot pin as a single integral piece. An example of such a one-piece cast draft sill 180 is shown in FIG. 12. In this example, the boss 188 has eight ribs 202 evenly spaced around the circumference of the integral cylindrical center pin 190. The ribs 202 in the second illustrated embodiment are shaped like the ribs in the first illustrated embodiment, and extend from an inner limit at smoothly curved junctures 204 with the outer surface of the center pin 190 to outer limits 206 at the junctures with the bottom exterior surface 184 of the draft sill. The junctures 204 of the ribs 202 and the center pin 190 are spaced between the bottom wall 184 of the draft sill and free end 208 of the center pin 190. In this embodiment, the only horizontal surface area below the bottom wall 184 of the draft sill is the annular surface 209 at the free end 208 of the center pin 190. This annular surface 209 is perpendicular to the longitudinal centerline 210 of the center pin 190. The center pin 190 has a cylindrical inner wall 211 that has one inner diameter on the exterior of the draft sill; a portion of the cylindrical inner wall 211 has this same inner diameter into the interior 212 of the draft sill, the inner diameter expanding within the interior of the draft sill. Thus, within the interior 212 of the draft sill, between the bottom 184 and top 186 walls, the center pin 190 comprises a thick-walled cast interior cylinder. The thicker cast walls 214 extend up from the bottom wall 184 and taper into thinner walls 216 that extend upward to the top 186 of the draft sill. These thicker walls 214 provide an alternative interior means for bracing for the center pin 190 against buff and draft forces within the draft sill and spaced from the outer surface or bottom wall 184 of the draft sill. The walls 214, 216 may be braced by longitudinal braces 222 on the side walls 224 in the interior of the draft sill, as in the first illustrated embodiment.

Figure 13:
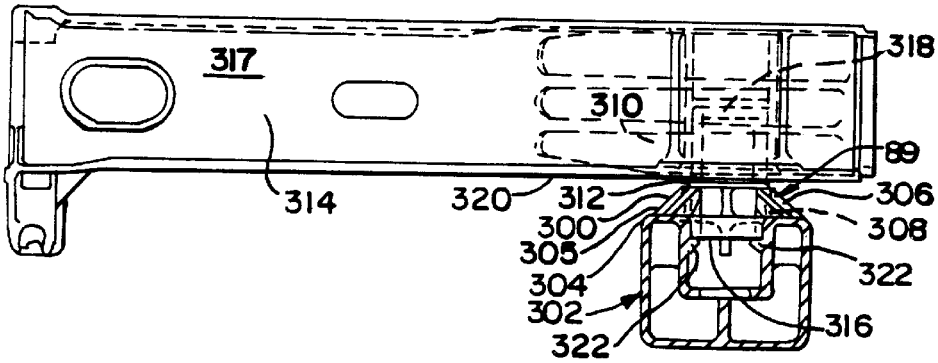
FIG. 13 is a side elevation of an alternative embodiment of the present invention, showing an alternative draft sill mounted on an alternative truck bolster which is shown in cross-section, with the side frame and wheels removed for clarity of illustration.

Another alternative embodiment is shown in FIG. 13. In that view, the bolster is shown in cross-section while the draft sill, boss and center pin are shown in side elevation. As there shown, the boss 300 may be formed integrally as part of the truck bolster 302 or welded to the truck bolster instead of part of the draft sill as in the first illustrated embodiment. As there shown, the boss 300 extends upwardly from the top surface 304 of the truck bolster 302, with its outer limit or diameter 305 on the top surface 304 of the truck bolster and its inner limit 312 at the center pin 310. In the third illustrated embodiment, the boss 300 has eight ribs 306 evenly spaced around the circumference of the annular cylinder 308 which receives the center pin 310. It should be understood that the structure of the boss 300 is provided for purposes of illustration; as in the first illustrated embodiment, many other forms and structures of boss or bracing means may be employed.

The boss 300 may be welded to the center pin 310 along an annular weld line at the boss'inner limit 312, and a liner provided in a receiving opening for the center pin in the draft sill 314. Alternatively, the center pin could be integral with the boss and truck bolster. As another alternative, the center pin 310 could be welded to or integral with the draft sill, with rotational movement being between the center pin and the boss and draft sill.

In the embodiment of FIG. 13, one end 316 of the center pin 310 is received within the interior of the truck bolster, below the top surface of the bolster, and the other free end 318 of the center pin is received within the interior of the draft sill 314, above the bottom 320 of the draft sill and between the side walls 317. In this embodiment, stops 322 are formed in the interior of the truck bolster; the bolster end 316 of the center pin 310 is received against these stops 322.

While only specific embodiments of the invention have been described and shown, it is apparent that various alternatives and modifications can be made thereto. Those skilled in the art will recognize that certain modifications can be made in these illustrative embodiments. It is, therefore, the intention in the appended claims to cover all such modifications and alternatives as may fall within the true scope of the invention.

We claim:

1. In a draft sill for mounting a railroad car on a railway wheel truck of the type having a bolster extending between two sideframes, the draft sill being of the type having an exterior surface, an interior on one side of the exterior surface and an exterior on the other side of the exterior surface, the improvement wherein the draft sill includes:

a center pin extending outward from the exterior surface of the draft sill for mounting the railroad car on the railway wheel truck and for moving the railway wheel truck with movement of the railroad car and for slowing movement of the railroad car with braking of the railway wheel truck, the center pin having an exterior end spaced from the exterior surface of the draft sill; and exterior means for bracing the center pin, the exterior means for bracing the center pin being secured to the draft sill and providing bracing to the center pin at a position spaced from the exterior surface of the draft sill and spaced from the exterior end of the center pin;

the center pin having an exposed outer surface between the free end and the exterior means for bracing, the exposed outer surface of the center pin being shaped so that when the draft sill is mounted on the railway wheel truck, relative rotation between the draft sill and railway wheel truck bolster is substantially limited to rotation about one axis of the center pin.

2. The improved draft sill of claim 1 wherein the center pin has a central longitudinal axis and wherein the total area of surfaces on the center pin and exterior means perpendicular to the central longitudinal axis of the center pin is less than the surface area of a standard center plate.

3. The improved draft sill of claim 1 wherein the draft sill includes a top wall, side walls depending from the top wall, and a bottom wall extending between portions of the side walls, the interior of the draft sill being between the top wall, side walls and bottom wall, the exterior means for bracing extending from the bottom wall and the center pin extending through and past the bottom wall into the interior of the draft sill, the draft sill further comprising interior means for bracing the center pin against buff and draft forces, the interior means for bracing the center pin providing bracing at a position within the interior of the draft sill, the draft sill further comprising a rib extending between side walls and the interior means for bracing the center pin.

4. The improved draft sill of claim 1 wherein the exterior means for bracing the center pin comprises a boss on the exterior surface of the draft sill.

5. The improved draft sill of claim 4 wherein the boss comprises a plurality of ribs extending from the exterior surface of the draft sill to the outer diameter of the center pin.

6. The improved draft sill of claim 5 wherein the boss is attached to the center pin at a position between the ribs.

7. The improved draft sill of claim 5 wherein each rib comprises, in cross-section, a right triangle with one leg longer than the other leg and wherein the longer leg is attached to the exterior surface of the draft sill.

8. The improved draft sill of claim 4 wherein the boss includes an annular surface surrounding the center pin and a plurality of ribs extending radially from the annular surface to the exterior surface of the draft sill, the center pin being welded to the annular surface.

9. The improved draft sill of claim 8 wherein the center pin includes an interior end within the interior of the draft sill and the draft sill further comprises an interior cylindrical tube within which a portion of the center pin is held, the interior cylindrical tube being sized to hold the center pin substantially free from horizontal movement.

10. The improved draft sill of claim 1 wherein the center pin has a central longitudinal axis and wherein the exterior means for bracing the center pin comprises a strut extending from the center pin to the exterior surface of the draft sill, the strut defining an angle with the central longitudinal axis of the center pin, the angle having vertical and horizontal components.

11. The improved draft sill of claim 1 wherein the center pin has a central longitudinal axis and a surface area at its exterior end perpendicular to its central longitudinal axis that is free from vertical load when mounted on a railway wheel truck under normal operating conditions.

12. The improved draft sill of claim 1 wherein the center pin has a central longitudinal axis and wherein the surfaces perpendicular to the central longitudinal axis of the center pin comprise an annular surface at the free exterior end of the center pin and an annular surface on the exterior means for bracing the center pin.

13. The improved draft sill of claim 1 wherein the exterior means for bracing the center pin and the exterior surface of the draft sill are an integral casting.

14. In a draft sill for mounting a railroad car on a railway wheel truck, the draft sill being of the type having an exterior surface, an interior on one side of the exterior surface and an exterior on the other side of the exterior surface, the improvement wherein the draft sill includes:

a center pin extending outward from the exterior surface of the draft sill for mounting the railroad car on the railway wheel truck and for moving the railway wheel truck with movement of the railroad car and for slowing movement of the railroad car with braking of the railway wheel truck, the center pin having an exterior end spaced from the exterior surface of the draft sill; and exterior means for bracing the center pin, the exterior means for bracing the center pin being secured to the draft sill and providing bracing to the center pin at a position spaced from the exterior surface of the draft sill and spaced from the exterior end of the center pin;

the exterior means for bracing the center pin comprising a boss on the exterior surface of the draft sill;

wherein the boss includes an annular surface surrounding the center pin and a plurality of ribs extending radially from the annular surface to the exterior surface of the draft sill, the center pin being welded to the annular surface; and wherein the boss is welded to the center pin at a plurality of positions between the ribs.

15. In a draft sill for mounting a railroad car on a railway wheel truck, the draft sill being of the type having an exterior surface, an interior on one side of the exterior surface and an exterior on the other side of the exterior surface, the improvement wherein the draft sill includes:

a center pin extending outward from the exterior surface of the draft sill for mounting the railroad car on the railway wheel truck and for moving the railway wheel truck with movement of the railroad car and for slowing movement of the railroad car with braking of the railway wheel truck , the center pin having an exterior end s paced from the exterior surface of the draft sill; and exterior means for bracing the center pin, the exterior means for bracing the center pin being secured to the draft sill and providing bracing to the center pin at a position spaced from the exterior surface of the draft sill and spaced from the exterior end of the center pin;

the exterior means for bracing the center pin comprising a boss on the exterior surface of the draft sill;

wherein the boss includes an annular surface surrounding the center pin and a plurality of ribs extending radially from the annular surface to the exterior surface of the draft sill, the center pin being welded to the annular surface;

wherein the boss has openings with edges between the ribs and the boss is welded to the center pin at the edges of the openings.

16. In a draft sill for mounting a railroad car on a railway wheel truck, the draft sill being of the type having an exterior surface, an interior on one side of the exterior surface and an exterior on the other side of the exterior surface, the improvement wherein the draft sill includes:

a center pin extending outward from the exterior surface of the draft sill for mounting the railroad car on the railway wheel truck and for moving the railway wheel truck with movement of the railroad car and for slowing movement of the railroad car with braking of the railway wheel truck, the center pin having an exterior end spaced from the exterior surface of the draft sill; and exterior means for bracing the center pin, the exterior means for bracing the center pin being secured to the draft sill and providing bracing to the center pin at a position spaced from the exterior surface of the draft sill and spaced from the exterior end of the center pin;

wherein the center pin has a central longitudinal axis and wherein the exterior means for bracing the center pin comprises a strut extending from the center pin to the exterior surface of the draft sill, the strut defining an angle with the central longitudinal axis of the center pin, the angle having vertical and horizontal components, and wherein the horizontal component of the angle is greater than the vertical component of the angle.

17. In a railroad car of the type having a load-carrying portion on a draft sill mounted on a railway wheel truck carrying a vertical load from the load-carrying portion, the railway wheel truck being of the type with a truck bolster extending between two sideframes to which the draft sill is pivotally connected, an improved connection assembly for connecting the draft sill and truck bolster comprising:

a center pin extending between the draft sill and the truck bolster for pivotally connecting the draft sill to the truck bolster, the center pin having a central longitudinal axis;

a boss positioned between the draft sill and the truck bolster, the boss having an inner portion at the outer surface of the center pin and an outer portion horizontally and vertically spaced from the inner portion;

wherein the center pin and boss are free from the vertical load of the load-carrying portion when the railroad car is at rest; and wherein relative pivoting between the draft sill and the truck bolster is substantially limited to pivoting about the central longitudinal axis of the center pin.

18. The improved connection of claim 17 wherein the total area of surfaces on the center pin and boss perpendicular to the central longitudinal axis of the center pin is less than the surface area of a standard center plate.

19. The improved connection of claim 17 wherein the draft sill and truck bolster are free from a center plate structure.

20. The improved connection of claim 17 wherein the center pin has a free end spaced from the inner portion of the boss, the inner portion of the boss being welded to the outer surface of the center pin.

21. The improved connection of claim 17 wherein the draft sill and boss comprise an integral casting.

22. The improved connection of claim 17 wherein the bolster and boss comprise an integral casting.

23. The improved connection of claim 17 wherein the center pin serves under normal operating conditions to move the railway wheel truck with the load-carrying portion and to slow the load-carrying portion when the railway wheel truck is braked.

24. The improved connection of claim 17 wherein the center pin has a central longitudinal axis and wherein the boss comprises a plurality of ribs having outer surfaces defining obtuse angles with the longitudinal centerline of the center pin.

25. The improved connection of claim 17 wherein the center pin has a free end received in a cylindrical opening in the truck bolster.

26. The improved connection of claim 25 wherein the cylindrical opening includes a liner to allow for rotation of the pin with respect to the truck bolster.

27. The improved connection of claim 17 wherein the boss is connected to the draft sill.

28. The improved connection of claim 17 wherein the boss is connected to the top surface of the truck bolster.

29. The improved connection of claim 17 wherein the boss and center pin are integral.

30. The improved connection of claim 17 wherein the center pin is welded to the boss along the inner portion of the boss.

31. The improved connection of claim 30 wherein the boss is welded to the center pin at a plurality of locations spaced from the inner portion of the boss.

32. The improved connection of claim 17 wherein the draft sill includes an interior and a cylindrical tube in the interior of the draft sill and open at one end, and wherein the center pin has an end received in the cylindrical tube.

33. The improved connection of claim 17 wherein the boss is attached to the center pin at a position between the inner portion of the boss and the horizontally and vertically spaced portion of the boss.

34. In a railroad car of the type having a load-carrying portion on a draft sill mounted on a railway wheel truck carrying a vertical load from the load-carrying portion, the railway wheel truck being of the type with a truck bolster extending between two sideframes to which the draft sill is pivotally connected, an improved connection assembly for connecting the draft sill and truck bolster comprising:

a center pin extending between the draft sill and the truck bolster for pivotally connecting the draft sill to the truck bolster;

a boss positioned between the draft sill and the truck bolster, the boss having an inner portion at the outer surface of the center pin and an outer portion horizontally and vertically spaced from the inner portion;

wherein the center pin and boss are free from the vertical load of the load-carrying a portion when the railroad car is at rest;

wherein the center pin has a central longitudinal axis and wherein the boss comprises a plurality of ribs having outer surfaces defining obtuse angles with the longitudinal centerline of the center pin;

wherein the boss has openings between the ribs and the boss is welded to the center pin at the openings.

35. In a railroad car of the type having a load-carrying portion on a draft sill mounted on a railway wheel truck carrying a vertical load from the load-carrying portion, the railway wheel truck being of the type with a truck bolster extending between two sideframes to which the draft sill is pivotally connected, an improved connection assembly for connecting the draft sill and truck bolster comprising:

a center pin extending between the draft sill and the truck bolster for pivotally connecting the draft sill to the truck bolster;

a boss positioned between the draft sill and the truck bolster, the boss having an inner portion, at the outer surface of the center pin and an outer portion horizontally and vertically spaced from the inner portion;

wherein the center pin and boss are free from the vertical load of the load-carrying portion when the railroad car is at rest;

wherein the boss comprises a plurality of ribs and wherein each rib comprises, in cross-section, a right triangle with one leg longer than the other leg.

36. In a draft sill for mounting a railroad car on a railway wheel truck, the draft sill being of the type having an interior and an exterior, the improvement wherein the draft sill includes:

top and bottom walls defining the interior of the draft sill;

a center pin extending out from the draft sill for mounting the railroad car on a railway wheel truck and having a central longitudinal axis and an exterior end exterior to the draft sill, the center pin having a width perpendicular to the central longitudinal axis; and a brace secured to the center pin at a position spaced from the exterior end of the center pin;

wherein the center pin has an exposed portion between the brace and the exterior end and wherein the exposed portion is free from any increase in width from the brace to the exterior end; and wherein the center pin has an inner wall within the interior of the draft sill between the top and bottom walls.

37. The draft sill of claim 36 wherein the brace is secured to the center pin at a plurality of positions.

38. The draft sill of claim 36 wherein the brace comprises a plurality of ribs extending radially outward from the center pin, each of the ribs being attached to the center pin.

39. The draft sill of claim 38 wherein the brace is secured to the center pin at a position between the ribs.

40. The draft sill of claim 38 wherein the draft sill has a bottom surface and wherein each of the ribs is integral with the draft sill bottom surface.

41. The draft sill of claim 38 wherein the brace includes an annular ring attached to the center pin and wherein each of the ribs extends radially outward from the annular ring.

42. The draft sill of claim 38 wherein each of the ribs comprises, in cross-section, a right triangle with one leg longer than the other leg, and wherein the longer leg is attached to the draft sill.

43. The draft sill of claim 42 wherein the brace includes an cylindrical ring encircling the center pin and wherein the shorter leg of each triangle is along the cylindrical ring.

44. The draft sill of claim 43 wherein the cylindrical ring has a plurality of openings and wherein the cylindrical ring is attached to the center pin through the openings.

45. The draft sill of claim 38 wherein the center pin has a central longitudinal axis and wherein each rib has an outer surface defining an obtuse angle with the central longitudinal axis of the center pin.

46. The draft sill of claim 36 wherein the draft sill includes a cylindrical tube within the interior of the draft sill and wherein the center pin includes an interior end received in the cylindrical tube.

47. The draft sill of claim 36 wherein the center pin has a central longitudinal axis and wherein the total area of surfaces on the center pin and brace perpendicular to the central longitudinal axis of the center pin is less than the surface area of a standard center plate.

48. The draft sill of claim 47 wherein the surfaces perpendicular to the central longitudinal axis of the center pin comprise a surface at the exterior free end of the center pin and an annular surface on the brace surrounding the center pin.

49. A draft sill comprising:

a surface;

a center pin extending out from the surface to a free end, the center pin having a central longitudinal axis;

a sleeve extending out from the draft sill surface and substantially surrounding a length of the center pin;

the sleeve including a plurality of spaced ribs extending radially outward from the center pin and integral with the surface of the draft sill;

the sleeve extending between the spaced ribs, parts of the ribs at a distance from the draft sill surface extending radially further from the central longitudinal axis of the center pin than parts of the sleeve between the ribs at the same distance from the draft sill surface.

50. The draft sill of claim 49 wherein the center pin has an outer surface and the sleeve includes an annular surface between the ribs and the outer surface of the center pin, the annular surface being perpendicular to the central longitudinal axis of the center pin, and wherein the parts of the sleeve between the ribs are attached to the outer surface of the center pin.

51. The draft sill of claim 49 wherein the attachment of the annular surface to the center pin is spaced from the surface of the draft sill.

52. The draft sill of claim 49 wherein the center pin has an exterior end surface perpendicular to the longitudinal axis and outside of the draft sill and wherein the total surface area of the annular surface and the exterior end surface of the center pin is less than the surface area of a standard center plate.

53. The draft sill of claim 49 wherein each of the ribs comprises, in cross section, a right triangle with one leg longer than the other leg and wherein the longer leg is attached to the surface of the draft sill.

54. The draft sill of claim 49 wherein the sleeve is integral with the surface of the draft sill.

55. The draft sill of claim 49 wherein the draft sill has an interior on one side of the surface, the draft sill further comprising an interior cylindrical tube disposed within the interior of the draft sill and wherein the center pin has an interior end received within the interior cylindrical tube.

56. A draft sill for use with railroad cars, the draft sill of the type adapted to transmit buff and draft forces from one end of the railroad car to the other end, the draft sill comprising:

a top wall;

side walls depending from the top wall between an open front end and a back end;

a bottom wall extending between portions of the side walls and having an exterior surface;

the draft sill having an interior defined by the top wall side walls and bottom wall;

a boss extending outward from the exterior surface of the bottom wall of the draft sill, the boss having an outer limit at the bottom wall exterior surface and an inner limit vertically and horizontally spaced from the outer limit; and a center pin integral with the boss and extending outward from the inner limit of the boss to a free end, the inner limit of the boss being between the free end of the center pin and the bottom wall exterior surface;

the center pin having a portion extending into the interior of the draft sill;

means for bracing the center pin against buff and draft forces the bracing means being within the interior of the draft sill.

57. The draft sill of claim 56 wherein the boss and the center pin are integral with the bottom wall of the draft sill.

58. The draft sill of claim 56 wherein the boss comprises a plurality of ribs extending between the center pin and the bottom surface of the draft sill.

59. The draft sill of claim 56 wherein the center pin has an inner cylindrical wall extending from its free end into the interior of the draft sill.

60. The draft sill of claim 59 wherein the inner cylindrical wall has an inner diameter exterior of the draft sill and a different inner diameter in a portion of the interior of the draft sill.

61. The draft sill of claim 56 wherein the center pin has a central longitudinal axis and an area at the free end of the pin perpendicular to the central longitudinal axis, and wherein the area at the free end is less than the surface area of a standard center plate.

62. A railroad car truck bolster for supporting a load-carrying compartment of a railroad car on a pair of wheel sets comprising:

a top surface;

a boss extending outward from the top surface of the bolster;

a center pin extending outward from the boss to a free end, the center pin having a longitudinal axis;

wherein the boss has an inner limit at the center pin and an outer limit vertically and horizontally spaced from the inner limit, the outer limit being at the top surface of the bolster and the inner limit being between the top surface of the bolster and the free end of the center pin; and wherein the center pin is shaped so that when the load-carrying compartment of the railroad car is supported on the car truck bolster, relative rotation between the truck bolster and the load-carrying compartment is limited to rotation about the longitudinal axis of the center pin.

63. The railroad car truck bolster of claim 62 wherein the boss comprises a plurality of ribs extending between the center pin and the top surface of the bolster.

64. The railroad car truck bolster of claim 62 wherein the boss is integral with the top surface of the truck bolster.

65. The railroad car truck bolster of claim 62 wherein the boss is attached to the center pin at the inner limit of the boss.

66. The railroad car truck bolster of claim 62 wherein the center pin has an end received within the truck bolster so that the top surface of the truck bolster is between the two ends of the center pin.

67. The railroad car truck bolster of claim 62 wherein the boss is attached to the center pin at a position between the inner limit and outer limit of the boss.

68. A draft sill for mounting a railroad car on a railway wheel truck, the draft sill including:

an exterior surface;

a center pin extending outward from the exterior surface of the draft sill, the center pin having an exterior end spaced from the exterior surface of the draft sill and an outer surface; and a boss having an inner portion at the outer surface of the center pin and an outer portion horizontally and vertically spaced from the inner portion, the boss including a plurality of ribs;

each rib comprising, in cross-section, a right triangle with one leg longer than the other leg.

69. In a railroad car of the type having a load-carrying portion on a draft sill mounted on a railway wheel truck carrying a vertical load from the load-carrying portion, the railway wheel truck being of the type with a truck bolster extending between two sideframes to which the draft sill is pivotally connected, an improved connection assembly for connecting the draft sill and truck bolster comprising:

a center pin extending between the draft sill and the truck bolster for connecting the draft sill to the truck bolster;

the center pin having a central longitudinal axis and allowing relative rotation between the draft sill and the truck bolster about the central longitudinal axis of the center pin;

a boss positioned between the draft sill and the truck bolster, the boss having an inner portion at the outer surface of the center pin and an outer portion horizontally and vertically spaced from the inner portion;

load-carrying members supported on the top surface of the truck bolster outboard of the center pin and boss for supporting the vertical load of the load-carrying portion when the railroad car is at rest; and suspension members for supporting the bolster at the sideframes outboard of the load-carrying members on the top surface of the bolster;

wherein the center pin and boss are free from the vertical load of the load-carrying portion when the railroad car is at rest; and wherein the center pin, boss and truck bolster may pivot as a unit about an axis other than the central longitudinal axis of the center pin.

70. The improved connection assembly of claim 69 wherein the boss comprises a plurality of reinforcing ribs substantially surrounding the center pin.

* * * * *

UNITED STATES PATENT AND TRADEMARK OFFICE

CERTIFICATE OF CORRECTION

PATENT NO. : 5,809,899

DATED : September 22, 1998

INVENTOR(S) : Horst T. Kaufhold, John J. Steffen and Franklin S. McKeown, Jr.

It is certified that error appears in the above-identified patent and that said Letters Patent is hereby corrected as shown below:

On the Title page, item [75]:

delete "Mich." and insert --MO.--

Signed and Sealed this

Twenty-second Day of December, 1998

Bruce Lehman

*Attest:*

BRUCE LEHMAN

*Attesting Officer*

*Commissioner of Patents and Trademarks*